US011573017B2

(12) United States Patent
Smith et al.

(10) Patent No.: US 11,573,017 B2
(45) Date of Patent: Feb. 7, 2023

(54) VENTILATION SYSTEM FOR A LARGE INDUSTRIAL SPACE

(71) Applicant: Airscape, Inc., Medford, OR (US)

(72) Inventors: Neil B. Smith, Ashland, OR (US); Richard Jacobi, Grants Pass, OR (US); Steven J. Miner, Ashland, OR (US)

(73) Assignee: Airscape, Inc., Medford, OR (US)

( * ) Notice: Subject to any disclaimer, the term of this patent is extended or adjusted under 35 U.S.C. 154(b) by 333 days.

(21) Appl. No.: 16/947,787

(22) Filed: Aug. 17, 2020

(65) Prior Publication Data

US 2021/0048204 A1 Feb. 18, 2021

Related U.S. Application Data

(60) Provisional application No. 62/888,156, filed on Aug. 16, 2019.

(51) Int. Cl.
*F24F 7/013* (2006.01)
*F24F 11/88* (2018.01)

(52) U.S. Cl.
CPC ..... *F24F 7/013* (2013.01); *F24F 11/88* (2018.01)

(58) Field of Classification Search
CPC .... F24F 7/013; F24F 11/88; F24F 2011/0002; F24F 2013/205; E06B 7/03; E06B 2007/023; E06B 2009/1527; E06B 9/15; F04D 25/166; F04D 25/16
USPC ..... 454/195
See application file for complete search history.

(56) References Cited

U.S. PATENT DOCUMENTS 4,779,518 A * 10/1988 Artwick ..... F24F 13/142 16/361
5,943,730 A 8/1999 Boomgararden
6,092,580 A * 7/2000 Lucas ..... E06B 3/485 160/113
6,874,990 B2 4/2005 Nadeau
7,497,774 B2 3/2009 Stevenson et al.
(Continued)

FOREIGN PATENT DOCUMENTS

EP 0971178 A2 1/2000
JP 58030795 U * 2/1983 ..... F24F 7/013

OTHER PUBLICATIONS https://www.woodmagazine.com/woodworking-how-to/shop-tips/fan-door-clears-shop-air (Year: 2018).*
(Continued)

*Primary Examiner* — Allen R. B. Schult
(74) *Attorney, Agent, or Firm* — Hall Estill Law Firm

(57) ABSTRACT

Method and apparatus for ventilating an interior space, such as a large industrial structure with at least one bay opening. A ventilation system includes an array of M by N fans stacked into a two dimensional (2D) array. A rigid frame supports the array. A seal assembly provides a nominally fluid-tight seal between an outer perimeter of the array and the bay opening. A locking assembly mechanically couples the frame to the bay opening. In some cases, a bay door can be partially retracted and attached to a top of the frame. In other cases, the bay door may be fluidically permeable (e.g., a chain, a screen, etc.) and the array is secured behind a fully closed door. Cooling air is directed out the bay opening at a suitable time, such as overnight. A soft-start motor capability can be used to initiate operation of the array.

20 Claims, 5 Drawing Sheets

(56) References Cited

U.S. PATENT DOCUMENTS

| | | | | |
|---|---|---|---|---|
| 9,163,845 | B1 | 10/2015 | Carlozzi | |
| 2006/0105696 | A1* | 5/2006 | Wenger | F24F 7/013 454/254 |
| 2008/0131101 | A1* | 6/2008 | Chen | F04D 25/166 388/825 |
| 2009/0084507 | A1 | 4/2009 | Tescher | |
| 2009/0124189 | A1 | 5/2009 | Barber | |
| 2009/0128065 | A1 | 5/2009 | Hsu et al. | |
| 2010/0197214 | A1* | 8/2010 | Geremia, Sr. | F24F 13/18 454/251 |
| 2011/0214615 | A1* | 9/2011 | Martin | A01K 1/00 119/448 |
| 2016/0131380 | A1* | 5/2016 | Price | F24F 11/89 454/229 |

OTHER PUBLICATIONS http://goatflieg.blogspot.com/2013/05/painting-ventilation-fan-unit-built.html (Year: 2013).*
https://www.wwgoa.com/video/diy-exhaust-fan-016078/ (Year: 2018).*
https://www.tcf.com/wp-content/uploads/2018/08/VFDs-For-Fans-A-Practical-Guide-White-Paper.pdf (Year: 2018).*

* cited by examiner

VENTILATION SYSTEM FOR A LARGE INDUSTRIAL SPACE

RELATED APPLICATION

The present application makes a claim of domestic priority to U.S. Provisional Patent Application No. 62/888,156 filed Aug. 16, 2019, the contents of which are hereby incorporated by reference.

BACKGROUND

Ventilation systems are used to supply environmentally controlled air to the interior of a structure, such as a residential habitation (e.g., a house) or an industrial space (e.g., a warehouse, etc.). A particularly useful type of ventilation system is sometimes referred to as a Whole House Fan ("WHF") system.

A typical WHF system operates to draw cooler outside air through the structure and then back out to the surrounding environment. The system is often operated at night or during other periods of time when the outside temperature is lower than the inside temperature. Large volumes of air are moved with sufficient dwell time to draw and transfer heat from the interior space to the surrounding environment. It has been found that WHF systems can often maintain a desired cool interior temperature with little or no need to operate traditional HVAC equipment, producing significant energy cost savings for a user.

While WHF systems have been found operable in reducing cooling costs and enhancing indoor comfort, there remains a continual need for improved efficiencies and applications. It is to these and other advancements that the present disclosure is directed.

SUMMARY

Various embodiments of the present disclosure are generally directed to ventilating an interior structure, such as a large industrial space.

In some embodiments, a ventilation system includes an array of M by N fans stacked into a two dimensional (2D) array, where M and N are integers. A rigid frame supports the array. A seal assembly provides a nominally fluid-tight seal between an outer perimeter of the array and the bay opening. A locking assembly mechanically couples the frame to the bay opening. In some cases, a bay door can be partially retracted and attached to a top of the frame. In other cases, the bay door may be fluidically permeable (e.g., a chain, a screen, etc.) and the array is secured behind a fully closed door. Cooling air is directed out the bay opening at a suitable time, such as overnight. A soft-start motor capability can be used to initiate operation of the array.

These and other features and advantages of various embodiments can be understood with a review of the following detailed description and the accompanying drawings.

DETAILED DESCRIPTION

Various embodiments of the present disclosure are generally directed to a new and improved ventilation system. The ventilation system can be utilized in a variety of applications, including but not necessarily limited to relatively large commercial structures (also referred to herein as "industrial structures" or "industrial spaces") that are serviced by one, or preferably a number of, garage-type bays.

As explained below, the ventilation system includes a fan assembly made up of an M×N (i.e., M by N) two-dimensional (2D) array of fans, where M and N are integers. The fans are relatively large and are sized such that the fan assembly fully spans the width of a selected bay. Such bays are often open during business hours and often have retractable bay doors which are usually closed at night or other times when the facility (or an individual bay) is non-operational.

The fan assembly is positioned to at least partially fill the selected bay opening. Once in place, the fan assembly exhausts heated air from the interior of the industrial space to the surrounding environment. It is contemplated that the fan assembly may operate overnight in order to reduce the internal temperature of the facility during the following day. Large volumes of air are contemplated as being moved by the fan assembly, such as on the order of 100,000 cfm (cubic feet per minute) or more. Efficient cooling can be supplied by drawing in cooler, exterior air through other openings within the structure. Sufficient flow and dwell time is established to draw the interior heat out of the structure and through the bay opening.

In some embodiments, sealing is provided at the juncture (s) between the fan assembly and the surrounding frame and bay doors to reduce blowback and enhance operational efficiency. The fan assembly may be arranged to be portable, such as through the use of castors, to enable the fan assembly to be moved into place for use and then rolled out of the way during business hours to permit full access to the bay opening. A locking assembly may be used to enhance security of the facility while the ventilation system is operational. Additional locking screens or mechanisms can be provided behind the fan assembly to further facilitate security of the facility. A soft-start motor initialization sequence can be used to limit current draw during the initialization of the fans.

Figure 1:
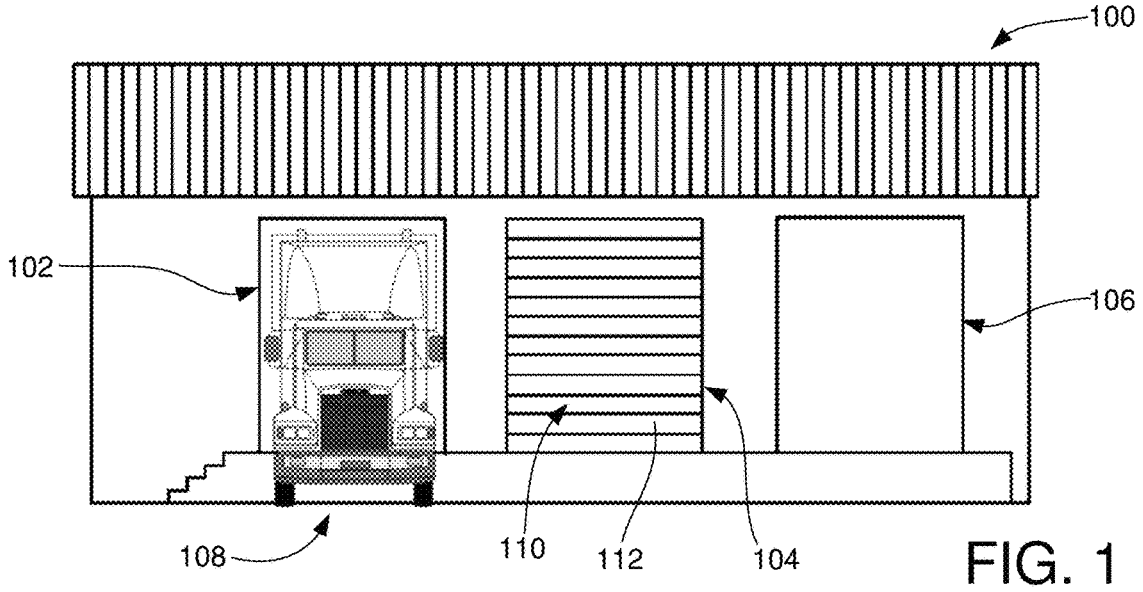
FIG. 1 is a diagrammatic depiction of a structure ("industrial space") of the type in which various embodiments of the present disclosure may be practiced.

These and other features and advantages of various embodiments can be understood beginning with a review of FIG. 1 which shows a schematic depiction of a commercial structure 100. The structure, also referred to as an industrial space, is of the type that may be used in a variety of applications (e.g., a warehouse, a distribution center, a manufacturing space, etc.). It is contemplated that the interior of the structure 100 is provided with an open floor plan (e.g., not divided up into separate rooms, but rather one, or a small number of, interior spaces). The interior may have rows of shelving, manufacturing equipment, paint booths, etc. as required for the commercial activities undertaken therein.

Access to the interior of the structure is provided by way of a number of bays, also referred to as bay openings. Three such bays are indicated at 102, 104 and 106. A semi-tractor trailer rig 108 is shown to be backed up to and aligned with the first bay 102 to enable the contents of a trailer portion of the rig to be offloaded and transported into the interior of the space. The transportation of such contents may be handled using forklifts or other mechanical means.

The second bay 104 is shown to be closed by way of a bay door 110 that is formed of a number of adjacent slats 112 that can be extended (closed) or retracted (opened) as required. The third bay 106 is shown to be open (e.g., the associated bay door has been retracted, as is the case for the first bay 102 as well). The slats can take any number of configurations and sizes.

Figure 2A:
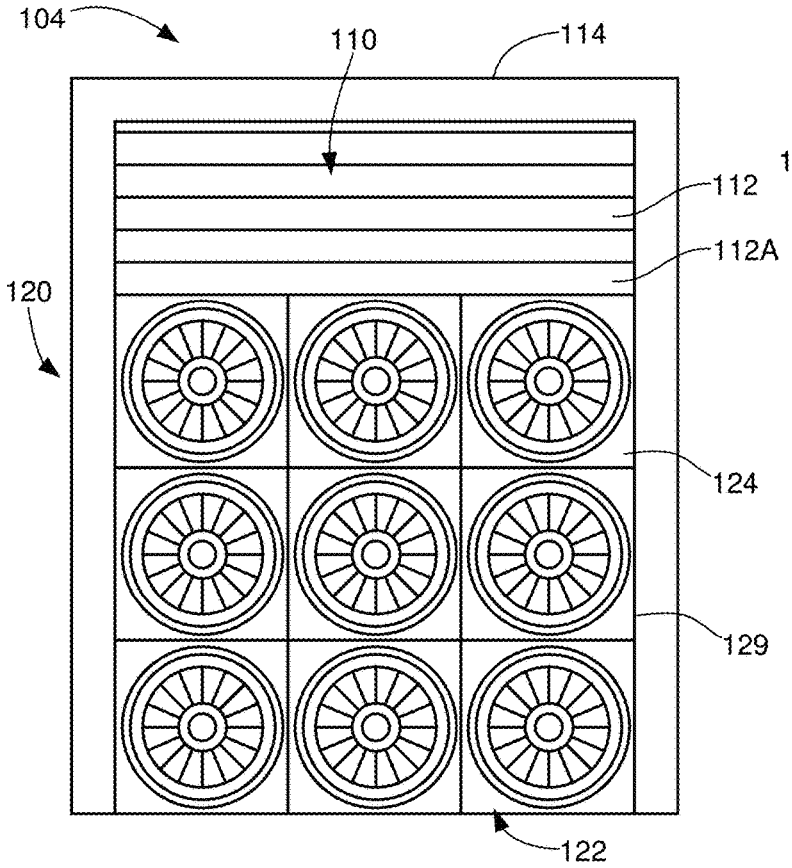
FIGS. 2A and 2B show front and side views of a ventilation system configured for use with structures such as in FIG. 1 in accordance with some embodiments.
Figure 2B:
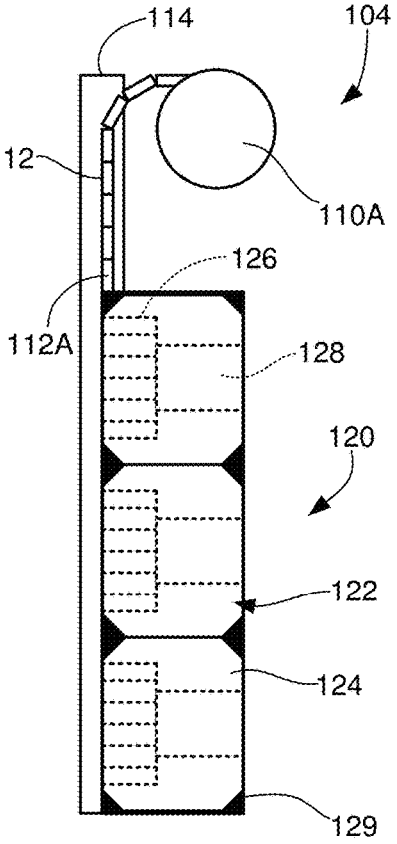

FIGS. 2A and 2B show the second bay 104 in greater detail during a time when the bay is not operational (e.g., overnight, etc.). A bay frame 114 surrounds the bay opening and provides tracks and other mechanisms to facilitate extension and retraction of the bay door 110.

A ventilation system 120 is positioned within the bay opening 104 as shown. The ventilation system 120 includes a fan assembly 122, also sometimes referred to as a wall of fans, made up of a number of individual fans 124. The fans 124 are arranged into a two-dimensional array of M×N fans where M and N are integers. The example shown in FIGS. 2A and 2B uses a 3×3 array (e.g., M=3 and N=3), but any suitable numbers and arrangements of fans can be used as required, including a single row of fans (e.g., a 4×1 matrix), a multi-row, non-square arrangement (e.g., a 3×2 matrix), etc.

The fans 124 in the fan assembly 122 can take any suitable shape and size, although rectilinearly shaped housings are contemplated for ease and efficiency of use. In some cases, a large unitary framework formed of a suitable material (e.g., metal, plywood, etc.) can be provided to house and support the fans in the desired alignment.

Larger fans tend to provide greater efficiencies at lower current (power) consumption levels, so in the present example it is contemplated that each of the fans have a nominal diameter of 48 inches each, and the entire fan assembly has an overall size of 132 inches by 132 inches (e.g., 12 feet×12 feet). However other sizes can be used, such as 30 inches, 36 inches, 42 inches, etc. The bay 104 is also contemplated in this example to be nominally 12 feet wide. It will be appreciated that these values are provided merely for purposes of providing a concrete example; any number and sizes of fan assemblies can be provided to fit any number and sizes of bay openings as required. For example, the fans 124 may be nominally 36 inches wide so that the fan assembly is nominally nine (9) feet across, and framework can be provided to cover the span of a larger bay opening (such as a ten (10) foot width opening). Other arrangements can be used.

As best viewed in FIG. 2B, each of the fans 124 includes an impeller assembly 126 having a number of radially extending fan blades and an electrical motor 128 configured to rotate the impeller assembly at a desired rotational rate. The bay door 110 is partially retracted so that a lowest slat 112A is resting on and attached to the top of the fan assembly 122. The remaining slats 112 in the door 110 extend upwardly and are partially retraced into a bay door retraction canister 110A. Other configurations for the bay doors can be used as desired. It is contemplated, albeit not necessarily required, that the slats in the bay doors will be solid (e.g., not fluidically permeable).

A reinforced frame may be used to support and interlock the fans into the ventilation unit. The frame, generally denoted at 129, can be formed of any suitable rigid material such as metal, plywood, etc. to form a lattice structure that surrounds and extends between the respective fans. The frame depicted in FIGS. 2A-2B is contemplated as being formed of angle iron and/or tubular iron with various reinforcing struts as required.

Figure 3A:
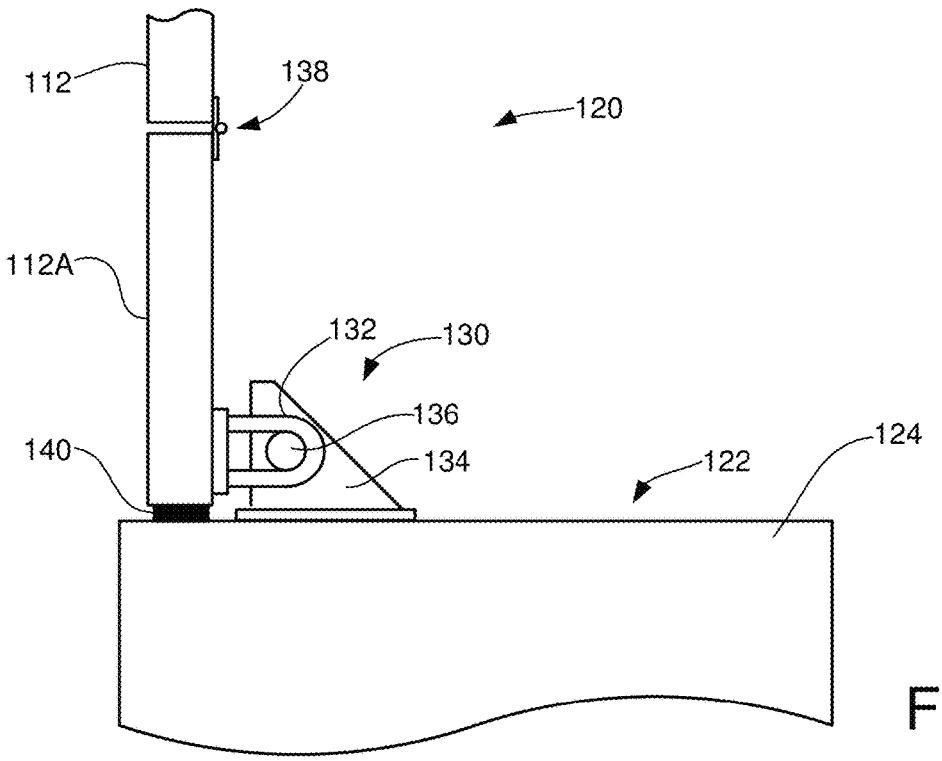
FIGS. 3A and 3B provide side and rear detailed views of the system in accordance with further embodiments.
Figure 3B:
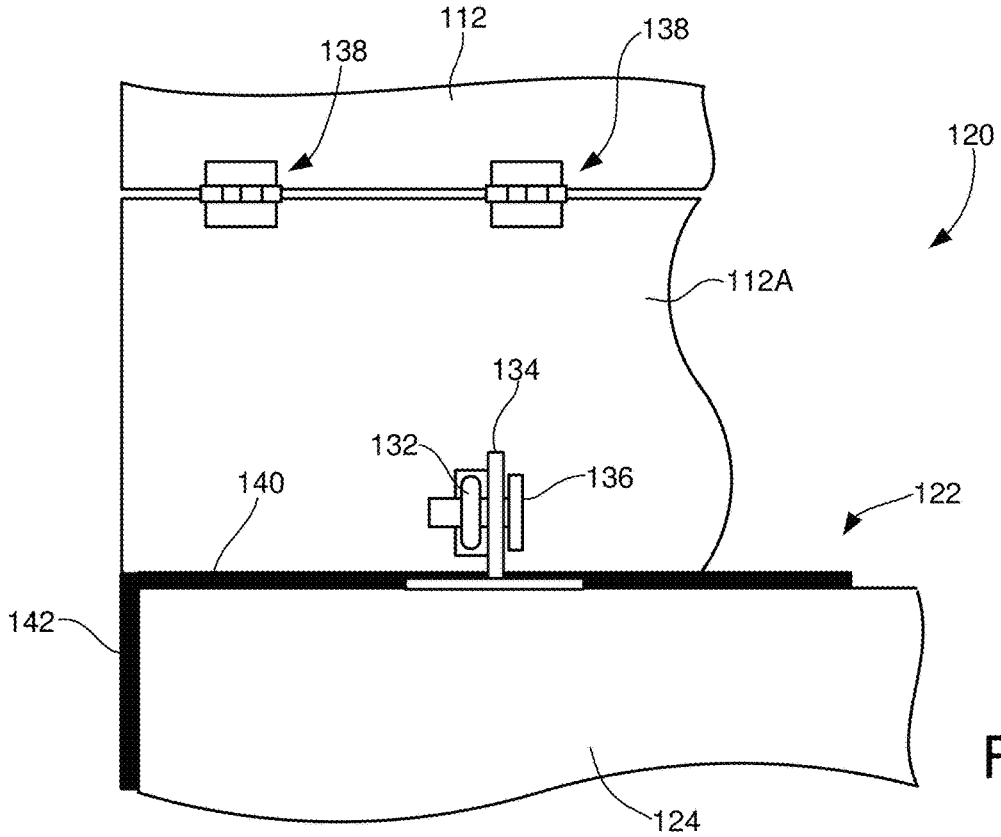

FIGS. 3A and 3B show the ventilation system 120 in greater detail. FIG. 3A is a side elevational view and FIG. 3B is a back elevational view.

The lowermost slat 112A in the garage door 110 is locked to the top of the fan assembly 122 (e.g., a portion of the frame 129) using a locking mechanism 130. The locking mechanism 130 can take any number of suitable forms, but is configured to mechanically affix the door 110 to the fan assembly 122 to provide a secure barrier against unauthorized entry into the interior space of the structure 100.

The mechanism 130 in FIGS. 3A and 3B includes a generally U-shaped bar 132 that is secured to a framework 134 of the fan assembly 122 by way of a transversely arranged pin 136. The pin can be secured with a cotter pin (not shown). Other locking arrangements can be used such as a shackle, a padlock, a deadbolt, etc.

The individual panels 112, 112A are hinged via a sequence of hinges 138. A top seal 140 is formed of a layer of elastomeric sealing material which is sandwiched between the top surface of the fan assembly 122 and the lowermost slat 112A as shown. As required, a side seal 142 comprising another layer of elastomeric sealing material can be sandwiched between a side surface of the fan assembly 112 and the frame 114 of the bay opening (see e.g., FIG. 2A). These seals help to seal the interface between the interior and exterior environments and enhance the efficiency of the fans as they establish airflow from the interior of the structure.

Figure 4A:
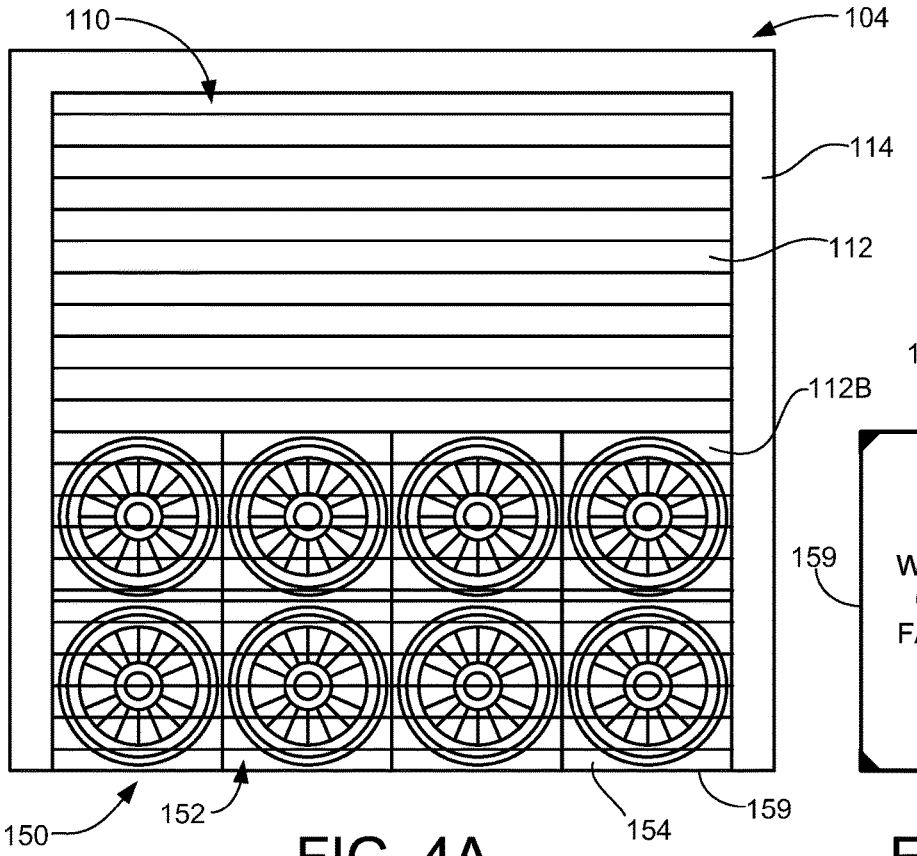
FIGS. 4A and 4B show front and side view depictions of another ventilation system in accordance with further embodiments.
Figure 4B:
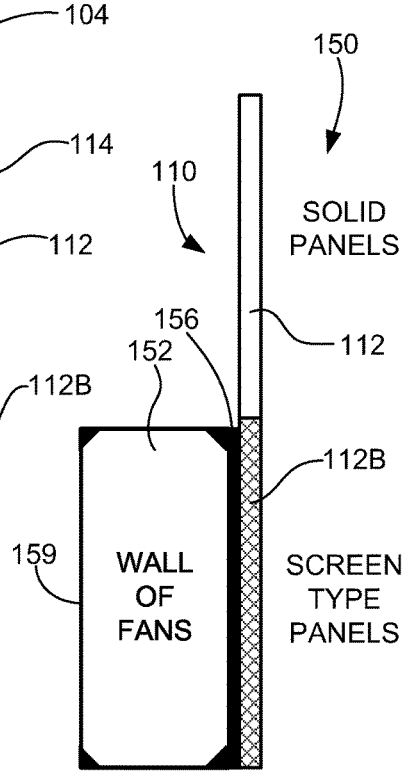

FIGS. 4A and 4B show another ventilation system 150 constructed and operated in accordance with further embodiments. The system 150 includes a fan assembly 152 made up of a matrix of 4×2 fans 154 (e.g., M=4 and N=2). In this case, each of the fans 154 has a nominal diameter of about 36 inches, so that the fan assembly 152 has a size of about 132 inches by about 72 inches (12 feet×6 feet).

In this example, a lower number of slats 112B of the bay door 110 are arranged to have a mesh (e.g., an open, reinforced bar or screen configuration) so that the slats are fluidically permeable, as shown in FIG. 4B. A layer of sealing material 156 surrounds the outer perimeter of the fan assembly (wall of fans) 152 to enhance efficiency of the operation of the fans 154. In this way, a secure barrier is provided in front of the wall of fans 152 while allowing the airflow established by the fans to exhaust air from the structure.

As before, a reinforced frame 159 can be utilized to further enhance support and security, and one or more locking mechanisms, such as the locking mechanism 130 from FIGS. 3A and 3B, can be used to interconnect the fan assembly 152 to the door 110. These locking mechanisms can include deadbolt structures that extend into the floor and/or door frame as desired. As noted above, unlike the arrangement in FIGS. 2A-2B, the fan assembly 150 is disposed behind the closed bay door 110, and so the lower panels 122B provide further security against forced entry through the bay door opening.

Figure 5:
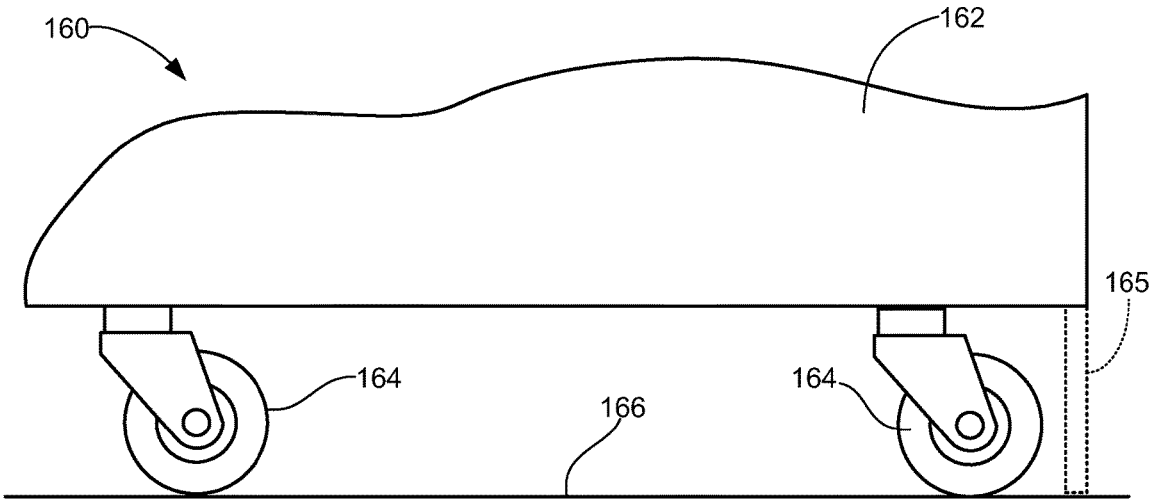
FIG. 5 depicts the use of castors to facilitate movement of the various ventilation systems embodied herein.

FIG. 5 shows another ventilation system having a fan assembly 160 made up of fans 162 that are arranged to be supported by a number of rollable castors 164. The castors 164 enable the fan assembly 160 to be moved along a base surface 166, such as a floor of the interior space of the structure 100. A sealing skirt 165 can be attached along the bottom most front edge of the fan assembly 160 to provide a seal between the lower portion of the fan assembly and the base surface 166 to further enhance sealing of the fan assembly.

Figure 6A:
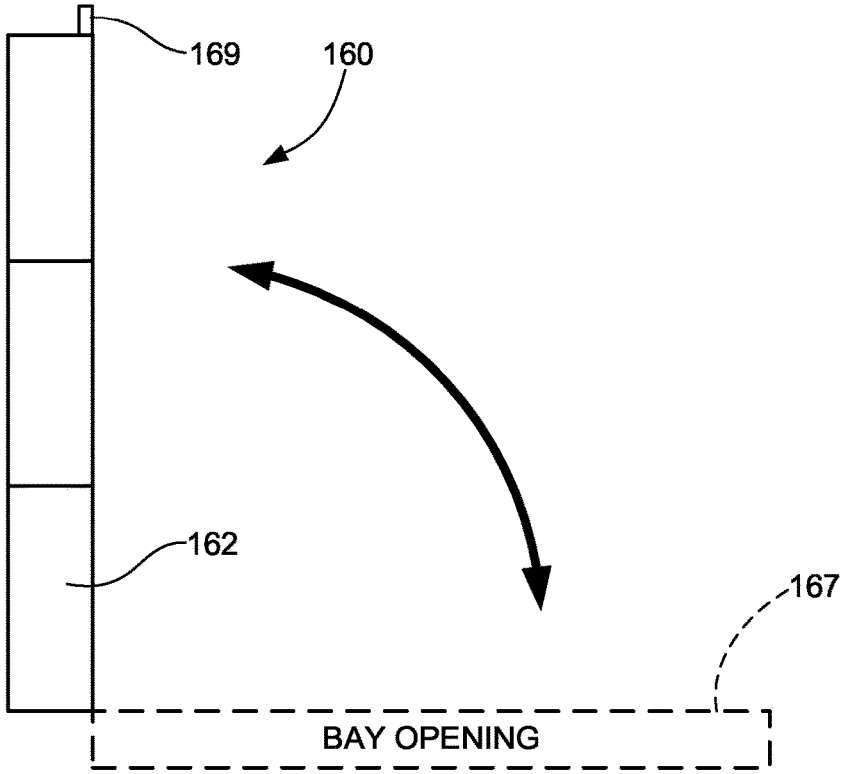
FIGS. 6A and 6B are schematic depictions of swinging movement that can be carried out using the various ventilation systems.
Figure 6B:
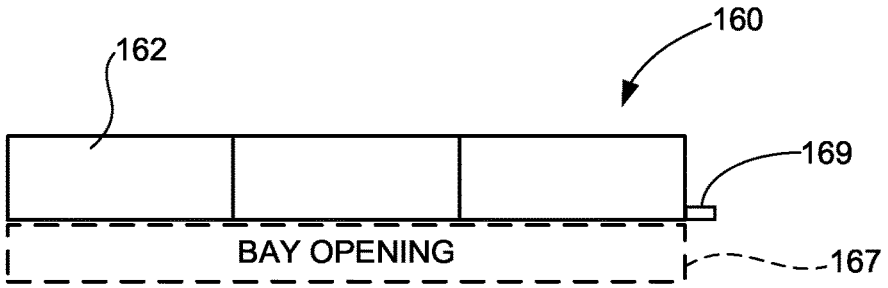
Figure 6C:
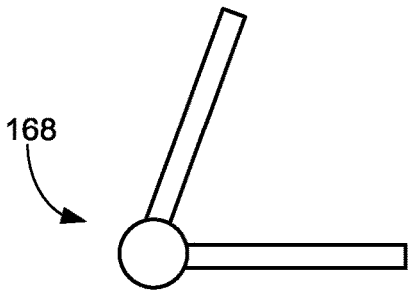
FIG. 6C shows a hinge assembly that can be used to attach a fan assembly to a frame of a bay opening.

FIGS. 6A and 6B show the portable capabilities of the fan assembly 160 of FIG. 5 with an associated bay opening 167. FIG. 6A shows the fan assembly 160 to be positioned in a non-operational position out of the way during a period of commercial activity in which the bay opening 167 is utilized to allow product to pass therethrough (such as from the tractor trailer rig 108 in FIG. 1). At such time that the fan assembly 160 is intended to exhaust air from the interior space, the fan assembly is rotated to an operational position as shown in FIG. 6B. As desired, a set of hinges such as at 168 in FIG. 6C can be used to affix a corner of the fan assembly 160 to the frame of the bay opening 167 to allow swinging movement of the fan assembly between the respective non-operational and operational positions of FIGS. 6A and 6B and to provide mechanical coupling of the fan assembly to the frame. Locking mechanisms such as denoted at 169 can be used to secure the fan assembly in the respective non-operational and operational positions of FIGS. 6A and 6B, such as locking bolts/pins that secure the opposite side of the fan assembly into the base floor of the structure and/or to the opposite side of the bay frame (see e.g., frame 114 in FIG. 2A).

Figure 7:
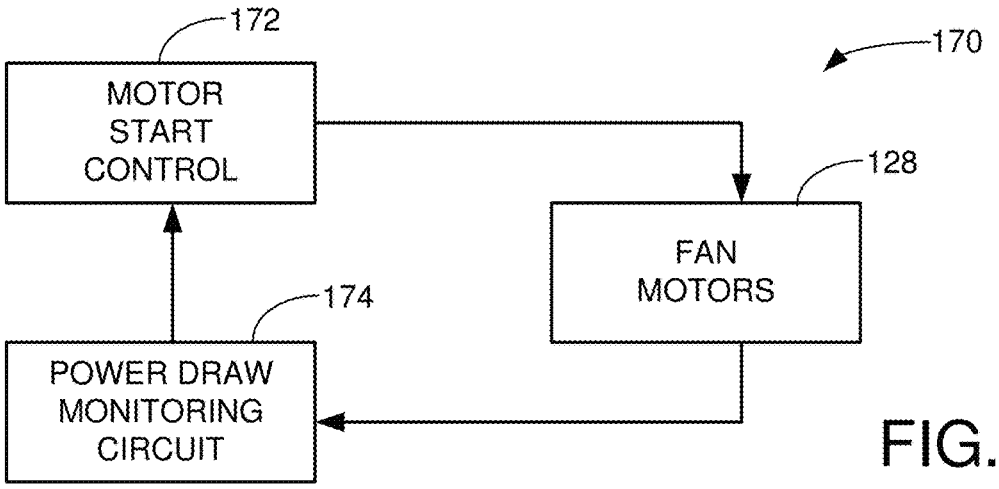
FIG. 7 is a functional block diagram for a control circuit that can be used in some embodiments to initiate operation of the fan assembly.

A motor start control circuit 170 is shown in FIG. 7. The circuit 170 is used to control the startup of the various fan motors during initial operation of the fan assembly. The circuit includes a motor start control circuit 172 which controllably supplies motor current to the various fan motors 128 (see FIG. 2B). A power draw monitoring circuit 174 monitors the current (or other power metric) to ensure that the motors come up to speed without excessive current/power draw.

The fan motors 128 can take any suitable form, such as multi-phase induction motors, electrically commutated motors (ECM), etc. One embodiment uses three-phase, ½ horsepower fans, although other styles and sizes can be used. It has been observed that motors of this type can draw upwards of 25-30 A (amps) or more for 5-10 seconds at start up. This amount of current draw may be sufficient to trip a protection circuit breaker for this style load, and that is just for a single fan. Extending separate electrical lines to run each fan would potentially be prohibitively expensive, and is unnecessary.

Instead, the motor start control circuit may include soft-start capabilities with a variable frequency drive or similar mechanism. In this way, the fans are activated either individually in sequence, in groups, or together, but at a sufficiently slow rate that the maximum current utilized during the initialization process stays below a predetermined acceptable limit. By creating a slow ramp up of the fans, it is possible to minimize the cost of running electrical wiring and avoiding the typically immense start up surge of a typical bank of fan motors.

Figure 8:
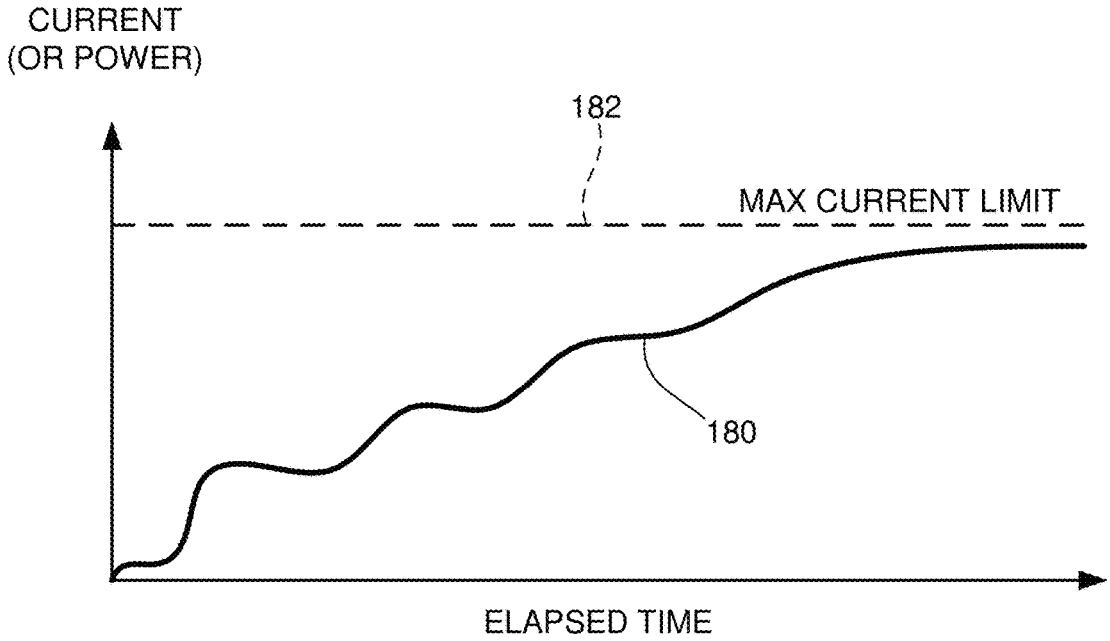
FIG. 8 is a graphical representation of motor current as controlled by the control circuit of FIG. 7 during initialization.

FIG. 8 is a graphical representation of a current curve 180 plotted against an elapsed time x-axis and a magnitude y-axis. Threshold 182 represents a maximum amount of current that may be drawn by the ventilation system during operation. By sequentially activating the various fans in turn, as well as controllably increasing the rotational speed, the total current drawn by the fan assembly can be controlled without exceeding the threshold 182. In arrangements such as the swinging configuration of FIGS. 6A-6C, flexible power cords can be arranged to enable electrical power to be supplied to the fans. In other embodiments, a special service plug (e.g., 220 VAC, etc.) can be disposed adjacent the door and a user can manually plug in the system prior to activation, and unplug the system when the wall of fans is to be moved out of the way. The control circuitry 170 of FIG. 7 can be disposed at any suitable location within the ventilation system.

Figure 9:
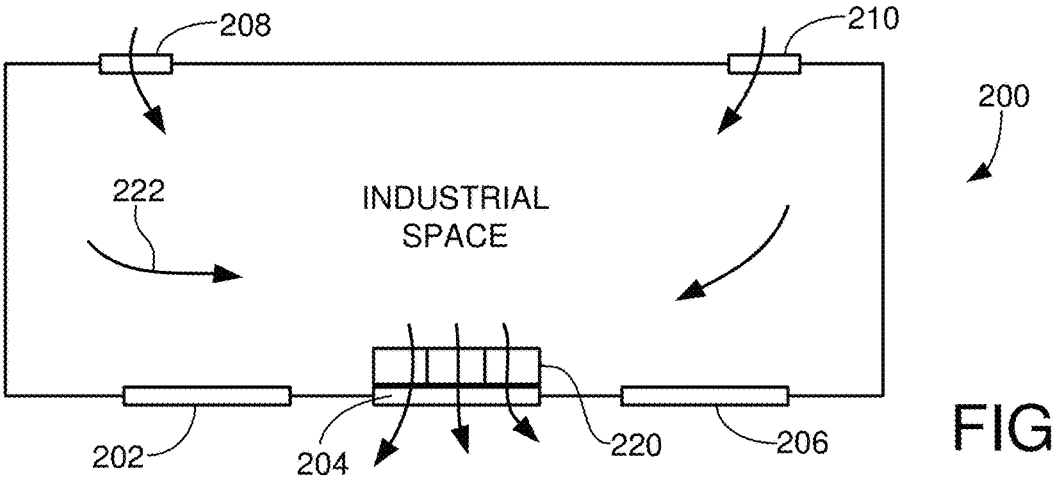
FIG. 9 shows another industrial space to illustrate a manner in which the ventilation systems disclosed herein can be advantageously used.

FIG. 9 shows another structure 200 (industrial space) similar to the space 100 of FIG. 1. The structure 200 has a number of bays including bays 202, 204 and 206. As desired, the structure 200 also has a number of other openings as well, such as windows 208, 210.

A ventilation system 220 including a wall of fans is secured in the middle bay 204 as described above. Operation of the system 220 results in airflow (arrows 222) being drawn through the structure 200 and outside to the exterior environment. It will be appreciated that the remaining bays 202, 206 may be closed during operation of the system 220. Placement of the system 220 at a medial location within the structure 200 (e.g., centrally located bay 204) is contemplated but not necessarily required. The use of multiple ventilation systems, including one in multiple bays or in each bay, can also be used depending on the heat transfer requirements of the structure. The windows 208, 210 (or other secured openings) can be opened to enable sufficient amounts of cooling airflow to flow into the industrial space during operation of the system 220.

As noted previously, large amount of airflow may be generated during a suitable cool period, such as overnight, in order to draw heat out of the building that built up during the previous day. In some embodiments, airflow rates on the order of from about 50,000 cfm to about 100,000 cfm are contemplated depending on the heat load and volume of the interior space. Other airflow rates above or below these values can be utilized as well. Motor sizes and fan configurations, including diameters of the impellers, can be optimally sized to meet the needs of a given application. While garage-type loading bays are contemplated as being particularly suitable as a location for the ventilation system, other styles and types of openings are contemplated as well.

It will now be appreciated that the various embodiments presented herein can provide a number of benefits. Large structures such as various industrial spaces can be efficiently and economically ventilated at suitable non-operational times, such as overnight, while allowing the ventilation system to be quickly and easily moved out of the way during business operations. The ventilation system can be securely locked in place to ensure effective operation and security for the structure. Sealing mechanisms can be used to ensure maximum efficiency of the fan operation. Additional features such as a soft-start motor capability can ensure that the power consumption of the system remains within acceptable limits. While it is contemplated that the fans will be directed outwardly, it is possible depending on a particular configuration to reverse this flow so that the fans direct cooling air inwardly into the interior of the structure. Similarly, fans that both blow into the interior at one location and blow out of the interior at another location can further be used depending on the ventilation requirements.

It is to be understood that even though numerous characteristics and advantages of various embodiments of the present disclosure have been set forth in the foregoing description, together with details of the structure and function of various embodiments of the disclosure, this detailed description is illustrative only, and changes may be made in detail, especially in matters of structure and arrangements of parts within the principles of the present disclosure to the full extent indicated by the broad general meaning of the terms in which the appended claims are expressed.

What is claimed is:

1. A ventilation system, comprising:

an array of M by N fans stacked into a two dimensional (2D) array, where M and N are integers;

a rigid frame which supports the array;

a plurality of castors that support the rigid frame on a horizontal floor surface of an industrial structure;

a seal assembly configured to provide a fluid-tight seal between an outer perimeter of the array and a bay opening of the industrial structure;

a hinge assembly configured to mechanically couple a first end of the frame to a first side of the bay opening to facilitate rotation of the ventilation system, via the castors, over a rotational range of at least 90 degrees between an operational position in which the ventilation system spans the bay opening and a non-operational position in which the ventilation system is placed in a clearing relation to traffic passing through the bay opening;

a first locking assembly that mechanically couples an opposing second end of the frame to an opposing second side of the bay opening while the ventilation system is in the operational position and that mechanically secures the opposing second end of the frame to a floor surface of the industrial space while the ventilation system is in the non-operational position; and a second locking assembly which contactingly secures a lowermost panel of a retractable bay door that spans the bay opening to an upper surface of the frame of the ventilation system responsive to rotation of the ventilation system to the operational position and to a lowering of the lowermost panel into contacting engagement with the upper surface of the frame;

the ventilation system further configured to generate an exhaust airflow while in the operational position and engagement of the first and second locking assemblies to cool an interior of the industrial structure.

2. The ventilation system of claim 1, wherein the seal assembly further comprises a sealing skirt that covers a gap between the frame and the floor surface established by the plurality of castors.

3. The ventilation system of claim 1, wherein the number and widths of the fans are selected to nominally span an overall interior width of the bay opening.

4. The ventilation system of claim 1, wherein the array comprises at least four (4) fans.

5. The ventilation system of claim 1, wherein M is at least three (3) and N is at least two (2).

6. The ventilation system of claim 1, further comprising a motor start control circuit comprising a variable frequency drive circuit configured to apply a soft-start initialization sequence to the fans and a power draw monitoring circuit that monitors a total amount of power draw during the soft-start initialization sequence to ensure that the total amount of power draw during the soft-start initialization sequence remains below a predetermined threshold.

7. The ventilation system of claim 1, wherein the bay opening is characterized as a garage-type opening with a horizontal width of nominally 10 feet or 12 feet.

8. The ventilation system of claim 7, wherein each of the first and second locking assemblies comprises at least one locking pin that extends through a corresponding aperture in a securement member.

9. The ventilation system of claim 1, wherein the exhaust airflow generated by the ventilation system comprises an airflow of from nominally 50,000 cubic feet per minute (cfm) to nominally 100,000 cfm.

10. The ventilation system of claim 1, wherein each fan has an electric motor and an impeller configured to generate airflow responsive to rotation of the impeller by the motor, the airflow directed outwardly from an interior of the industrial structure through the bay opening.

11. The ventilation system of claim 10, wherein the impeller in each fan has an outermost diameter of from nominally 30 inches to nominally 48 inches.

12. The ventilation system of claim 10, wherein the electric motor of each fan is a three-phase induction motor or an electrically commutated motor (ECM) with a rating of at least ½ horsepower.

13. A method for ventilating an industrial structure having a bay opening, the method comprising:

disposing a ventilation system to span the bay opening in an operational position, the ventilation system comprising an array of M by N fans stacked into a two dimensional (2D) array where M and N are integers, the ventilation system further comprising a rigid frame which supports the array, a plurality of castors that support the frame on a horizontally extending floor surface of the industrial space, a seal assembly configured to provide a fluid-tight seal between an outer perimeter of the array and the bay opening, a hinge assembly that mechanically couples a first end of the rigid frame to a first side of the bay opening, and a first locking assembly that mechanically couples an opposing second end of the rigid frame to an opposing second side of the bay opening;

lowering a retractable bay door comprising a plurality of horizontally extending panels that can be extended and retracted as required to respectively close and open the bay opening, the retractable bay door having a lowermost panel that is brought into contacting engagement with an upper surface of the rigid frame of the ventilation system in the operational position;

engaging a second locking assembly to mechanically couple the lowermost slat of the bay door to the upper surface of the rigid frame;

operating the ventilation system in the operational position and with the second locking assembly engaged to generate an airflow that flows from an interior of the industrial structure and through the bay opening to an exterior environment to supply cooling to the interior of the industrial structure;

subsequently disengaging the second locking assembly and retracting the retractable bay door to open the bay opening;

rotating the ventilation system about the hinge assembly at least 90 degrees with respect to the bay opening, via rolling movement of the rigid frame via the castors, to place the ventilation assembly in a non-operational position clear of traffic passing through the bay opening; and using the first locking assembly to secure the ventilation system in the non-operational position.

14. The method of claim 13, further comprising fully deploying the retractable bay door in the bay opening while the ventilation system is in the non-operational position so that the lowermost panel of the retractable bay door interconnects with a floor surface of the industrial structure to securely block the bay opening.

15. The method of claim 13, wherein each of the first and second locking assemblies comprises at least one locking pin that extends through a corresponding aperture in a securement member.

16. The method of claim 13, the ventilation system further comprising a skirt that sealingly covers a clearance distance from the frame to the horizontal floor surface of the industrial structure, the clearance distance established by the plurality of castors.

17. The method of claim 13, wherein the number and widths of the fans are selected to nominally span an overall interior width of the bay opening, wherein each fan comprises an electric motor and an impeller configured to generate the airflow responsive to rotation of the impeller by the electric motor, and wherein the impeller in each fan has an outermost diameter of from nominally 30 inches to nominally 48 inches.

18. The method of claim 13, wherein the airflow comprises an airflow of from nominally 50,000 cubic feet per minute (cfm) to nominally 100,000 cfm.

19. The method of claim 13, wherein the ventilation system is operated using a variable frequency drive circuit to apply a soft-start initialization sequence to the fans and a power draw monitoring circuit to monitor a total amount of power draw during the soft-start initialization sequence to ensure that the total amount of power draw during the soft-start initialization sequence remains below a predetermined threshold, the soft-start initialization sequence comprising initiating operation of each fan in turn in a selected sequence.

20. The method of claim 13, wherein the bay opening is characterized as a garage-type opening with a horizontal width of nominally 10 feet or 12 feet.

* * * * *